US005445274A

United States Patent [19]

Pharo

[11] Patent Number: 5,445,274

[45] Date of Patent: Aug. 29, 1995

[54] INFLATABLE PACKAGE INSERT

[76] Inventor: Daniel A. Pharo, c/o Air Packaging Technologies, Inc., 25620 Rye Canyon Rd., Valencia, Calif. 91355

[21] Appl. No.: 257,941

[22] Filed: Jun. 10, 1994

Related U.S. Application Data

[63] Continuation of Ser. No. 805,860, Dec. 10, 1991, abandoned.

[51] Int. Cl.[6] ..... B65D 81/03

[52] U.S. Cl. ..... 206/522; 383/3

[58] Field of Search ..... 206/522, 521; 383/3, 383/1, 120

[56] References Cited

U.S. PATENT DOCUMENTS

| | | | |
|---|---|---|---|
| 1,030,655 | 6/1912 | Ellis | 383/120 |
| 3,027,065 | 3/1962 | Lindquist et al. | 383/120 |
| 3,082,870 | 3/1963 | Vickery | 383/120 |
| 3,098,563 | 7/1963 | Skees | 206/522 X |
| 3,143,276 | 8/1964 | Nichols | 383/120 |
| 3,332,415 | 7/1967 | Ericson | 383/3 |
| 3,389,534 | 6/1968 | Pendleton | 206/522 |
| 3,762,454 | 10/1973 | Wilkins, Jr. | 383/1 |
| 3,851,814 | 12/1974 | Stage | 383/120 |
| 4,176,746 | 12/1979 | Kooi | 383/120 |
| 4,324,012 | 4/1982 | Cannaday | 206/521 |
| 4,465,188 | 8/1984 | Soroka et al. | 206/522 |
| 4,551,379 | 11/1985 | Kerr | 206/522 |
| 4,705,085 | 11/1987 | Brown | 206/522 X |
| 4,793,123 | 12/1988 | Pharo | 206/522 |
| 4,847,126 | 7/1989 | Yamashiro et al. | 206/522 X |
| 5,009,318 | 4/1991 | Lepinoy | 206/522 |
| 5,042,663 | 8/1991 | Heinrich | 206/522 |

FOREIGN PATENT DOCUMENTS

| | | | |
|---|---|---|---|
| 215778 | 6/1961 | Austria | 383/120 |

*Primary Examiner*—Allan N. Shoap
*Assistant Examiner*—Christopher J. McDonald
*Attorney, Agent, or Firm*—Donald S. Dowden

[57] ABSTRACT

An improved packaging system comprises several modifications of an inflatable package utilizing pressurized air to protect and cushion products for shipment. The improvements consist of novel flexible pouches, designed to fit corrugated shipping cartons, wooden crates and steel of molded plastic shipping containers. The product is inserted or placed within the perimeters of a support means such as a carton or box and pressurized air is injected into adjacent compartments in the bag to suspend or hold a product in a protected manner.

3 Claims, 3 Drawing Sheets

INFLATABLE PACKAGE INSERT

This is a continuation of application Ser. No. 07/805,860, filed Dec. 10, 1991, now abandoned.

BACKGROUND OF THE INVENTION

1. Field of the Invention

This invention relates generally to a packaging system and more particularly to an inflatable element adapted to be rolled or folded to assume a spiral or other configuration suitable for enveloping and retaining an article therein. In one embodiment, the inflatable element is configured for a custom-sized fit within an outer shipping container made of corrugated board, wood, metal or molded plastic.

2. Description of the Prior Art

Packaging has been known heretofore by which an article of merchandise is contained within an inflatable enclosure or envelope that is thereafter sealed and inflated. U.S. Pat. No. 4,597,244, issued on Jul. 1, 1986 to Daniel A. Pharo for "Method For Forming An Inflated Wrapping," discloses packaging of articles within an inflated, preferably heat-sealed single walled envelope.

U.S. Pat. No. 4,793,123, issued Dec. 27, 1988 to Daniel A. Pharo, discloses a similar packaging system consisting of a preferably heat-sealed inflatable element or bag capable of being rolled up into a spiral or similar configuration. The rolled-up bag contains an inflatable chamber and means for retaining an article within its rolled-up confines. The rolled-up bag is adapted to be placed within a closeable box. Upon inflation of the bag, the article to be packaged is thereby suitably encapsulated within the confines of the bag and box.

While the foregoing packaging systems have been effective, especially in connection with holiday gift wrapping and in providing a certain amount of tamperproof capability, it has been found that there nevertheless exists a need for inflatable packaging which also may be utilized for particularly delicate merchandise such as semiconductor electronic components, jewelry or other like merchandise known to be especially prone to damage during shipment or transit. It has also been found that there exists a need with respect to inflatable packaging to ensure that in the event the inflated envelope is inadvertently punctured, the packaging is not totally destroyed. This is particularly important in commercial shipping, in which packages are routinely subject to rough treatment that is especially likely to damage inflatable packaging. There also exists a need in connection with inflatable packaging to ensure that the inflated size or volume of the package is limited so that it is practical to transport inflated packages along with other more conventional packaging while at the same time having sufficient inflation capability or pressure to ensure adequate protection for the item encapsulated therein.

OBJECTS AND SUMMARY OF THE INVENTION

The foregoing and other improvements and advantages over the packaging systems known heretofore are provided by the present invention which, in one of its preferred embodiments, provides inflatable packaging in which one or more items of merchandise are carried within the folds or creases of an inflated envelope in such a way that they cannot move substantially in any direction relative to the packaging and are substantially surrounded by cushions of filler material, such as air, which is under pressure. Thus, the filler material functions to absorb and redistribute forces acting on the package thereby protecting a delicate item of merchandise encapsulated and suspended therein. These and other advantages may be achieved by certain improvements and variations over the inflatable roll-up type of packaging systems described in the prior patents identified hereinabove. In particular the present invention provides improvements in such packaging in which an inflatable element may be used to encapsulate an item or article within its confines after being folded, hinged, creased or otherwise turned inwardly upon itself and thereafter inflated. Where desired, the inflated package may be confined within or between rigid sidewalls of plastic or other material, preferably in the overall form of a box-like container.

The packaging system of the present invention comprises an inflatable and, in one embodiment, accordion-like package element which is capable, for example, of being manipulated so as to assume a folded, creased, hinged, spiral or other rolled-up configuration. For example, a single inflatable element may be divided into a plurality of differentiated but preferably communicating inflatable chambers. In one embodiment, the inflatable element also comprises a heat-sealed bag structure having no open ends. In such an embodiment, a pocket or open-ended pouch may be formed on an exterior surface of the element for retaining an article therein in such a way that the pouch with article therein may be disposed within the confines of overlying rolled-up portions of the element. The inflatable element may then, after being folded on itself and thereby enclosing the article to be protected, be at least substantially filled with a filler medium.

A filling means is provided for at least substantially charging the inflatable element with a suitable filler medium so as to at least substantially encapsulate and support the pouch and article within the rolled-up portions of the bag.

In carrying out the method steps of one embodiment of the present invention, an inflatable element or package is first formed, a pocket or pouch is also formed, an article is placed in the pouch, the package is folded or rolled up to dispose the pouch and article within the confines of the package, and the package is at least partially filled with the filler medium to retain the article therein. In certain packaging applications, the package is placed in a box or other shipping container either before or after the article is placed in the pouch.

In one preferred embodiment, the packaging system of the present invention comprises two or more layers of thermoplastic film such as polyethylene, polyester-coated films, polyurethane, polyvinylchorloride, polypropylene; polyvinylchloride, polypropylene and all other heat sealable plastics in thicknesses ranging from about 0.0005" to about 0.060". The plastic films used are flexible so that roll-up or other folding, creasing, hinging or spiralling features can be implemented. In use of the packaging system, an article to be shipped can be simply overwrapped by the folded or rolled-up element, for example, or it can be placed in pockets or pouches located on an exterior surface of the element. One or more such pouches may be formed on the inflatable element, or, a single pocket or pouch may contain multiple compartments, each compartment being separated and sealed from the others as desired. The assembly and location of pouches, formed by heat sealing, may be selected so as to provide hermetically, sealed individual pouches that contain articles to be shipped.

Prior to inflation, the inflatable element with the article placed in a pocket or pouch is then folded or "rolled" up around one or more articles to be protected. The folded or rolled-up package and surrounded articles may thereafter be inserted into a shipping container having a preselected shape. The inflatable element is then pressurized with air or a selected gas. This air or gas fills the inflatable element in such a manner as to surround and center the articles with one or more air cushion portions located between the inner walls of the shipping container and each of the articles.

The present invention also reduces the probability of puncture-related problems insofar as it is within the scope of the present invention to manufacture the outer wall panels of the inflatable element of rigid or semi-rigid material. Moreover, inflatable packaging having multiple independently inflatable chambers or channels is particularly effective, since a multi-chamber package can continue to provide protection even if some of its inflatable chambers are punctured during shipment.

The overall size of the present inflatable packaging may be controlled without detracting from the aesthetic appearance of the package by joining the inner and outer walls defining the protective inflatable chamber at predetermined locations. In this way the completed package may given, by way of example, a quilted appearance. Such an arrangement ensures that no particular chamber will balloon unacceptably so as to make the entire package difficult, impractical or uneconomical to transport.

BRIEF DESCRIPTION OF THE DRAWINGS

A better understanding of the objects, features and advantage of present invention can be gained from the following detailed description of the preferred embodiments thereof, in conjunction with the accompanying figures of the drawings, wherein a given reference character always designates the same element or part, and wherein.

BRIEF DESCRIPTION OF THE PREFERRED EMBODIMENTS

Figure 1:
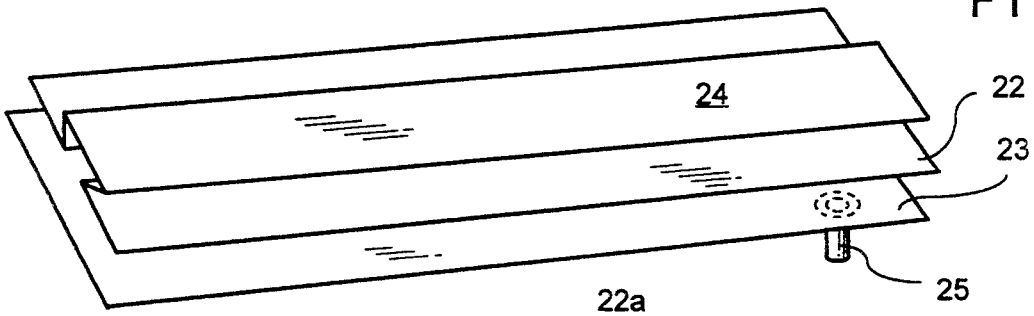
FIG. 1 is an exploded perspective view of a two-ply bag, prior to heat sealing, of a first embodiment of the present invention.

FIG. 1 shows a first embodiment of the present invention, in which a two-ply inflatable element is shown prior to heat sealing of the edges or side seams and is formed from a pair of overlying first and second panels 22 and 23, respectively. The panels are preferably at least generally rectangular and have outer peripheral edges thereof heat-sealed, glued or otherwise suitably secured together to define an inflatable chamber therebetween. The panels need not be substantially coextensive. In this embodiment, the upper panel 22 is shown to be larger than the lower panel 23 and to be longitudinally creased in four locations and folded on itself to form an elongate longitudinally extending pocket or gusset on the outer surface of the inflatable element, as shown at 24. Such an arrangement facilitates the ability of the inflatable element to be rolled up, creased or folded around one or more articles, as desired. The gusset may also serve as a compartment for an article. When so desired, only one end of the gusset is closed by a heat seal, thereby leaving an opening at the other end for the insertion of the article. Other seams may be formed transversely across the gusset to form predetermined pockets therein if desired.

Figure 3:
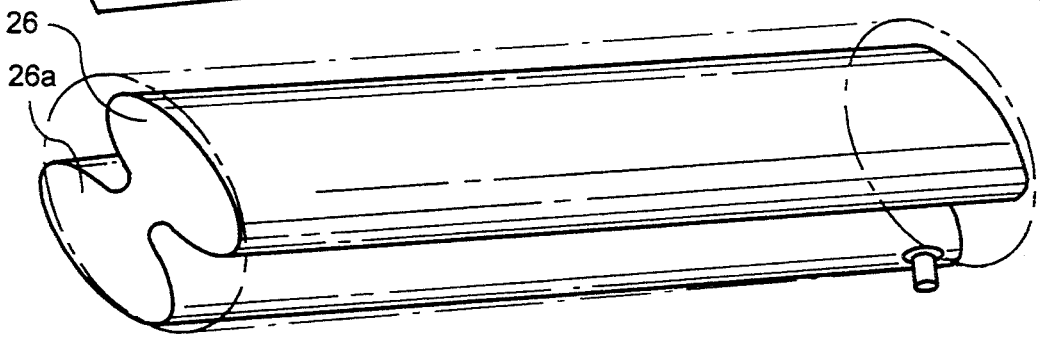
FIG. 3 is a perspective view of a "tube" type embodiment of the present invention.
Figure 4:
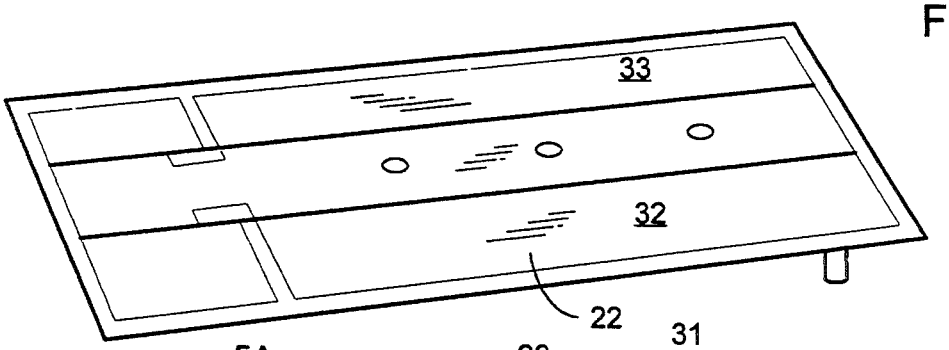
FIG. 4 is a perspective view of an embodiment of the present invention in its finished (heat sealed) state, prior to inflation.
Figure 5:
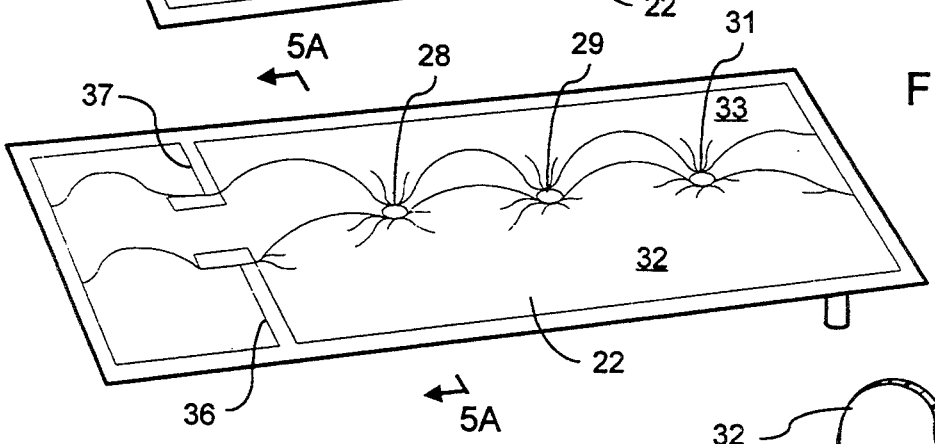
FIG. 5 is a perspective view of the embodiment of the present invention shown in FIG. 4 after inflation thereof.

The panels 22 and 23 are sealed together about their peripheries in a conventional manner to define opposite first and second seams at the ends of the element and opposite side seams, as shown in FIGS. 4 and 5. Alternatively, the panels can be preformed as a tube, i.e, seamless and forming a tubular and longitudinally extending gusset 26, as shown in FIG. 3.

Figure 2:
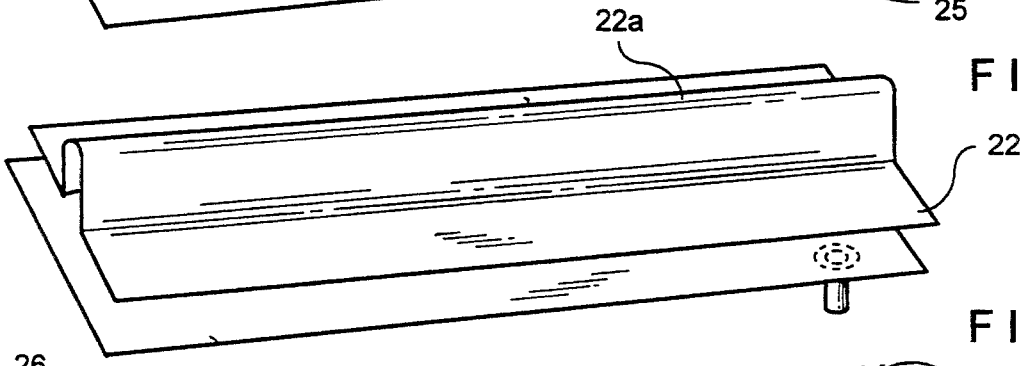
FIG. 2 is an exploded perspective view of a two-ply bag, prior to heat sealing, showing another embodiment of the present invention.

Other variations may be made in the shape or configuration of an inflatable element according to the present invention. For example, the upper panel 22 may be creased or folded only once to form upstanding rounded pocket **22*a*, as shown in FIG. 2**. The number of variations of packaging configurations based on the present structure are not limited and can be expanded into any number of pouch shapes adapted to fit various configurations of an outer rigid shipping container.

Figure 5A:
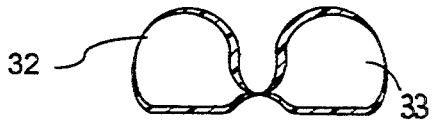
FIG. 5A is a cross sectional view of the embodiment of FIG. 4 taken along the line 5—5 of FIG. 5.

Other modifications may be made without departing from the scope of the invention. For example, the panels 22 and 23 may be heat-sealed together along a plurality of spot buttons or welds 28, 29, and 31 as shown in FIGS. 4 and 5. In FIG. 4, an inflatable element according to the present invention is shown in its finished (heat sealed) state, prior to inflation. Upon inflation, the inflatable element is divided into essentially double chambers 32 and 33 (FIGS. 5, 5A). In any of the foregoing embodiments, an entry port 25, which may consist of a self-closing valve, may be formed at one corner of one of the bag layers, for example the bottom layer 23.

FIG. 3, is a perspective view of a tubular embodiment of the present invention that can be folded in at the sides during the heat sealing process to form two longitudinal tubes 26 and **26*a*** out of the initial tube.

FIG. 5, is a perspective view of an inflatable element according to the present invention, after its inflation, showing the "puffed" effect created by the heat seal buttons 28, 29 and 31 arrange in arow. As the cross sectional view of FIG. 5A shows, upon inflation the inflatable element defines essentially a double tube, since the heat-seal buttons and transverse heat-sealed sealed lines 36 and 37 separate the single tube into a multi-chamber tube in which the chambers are side-by-side.

Figure 6:
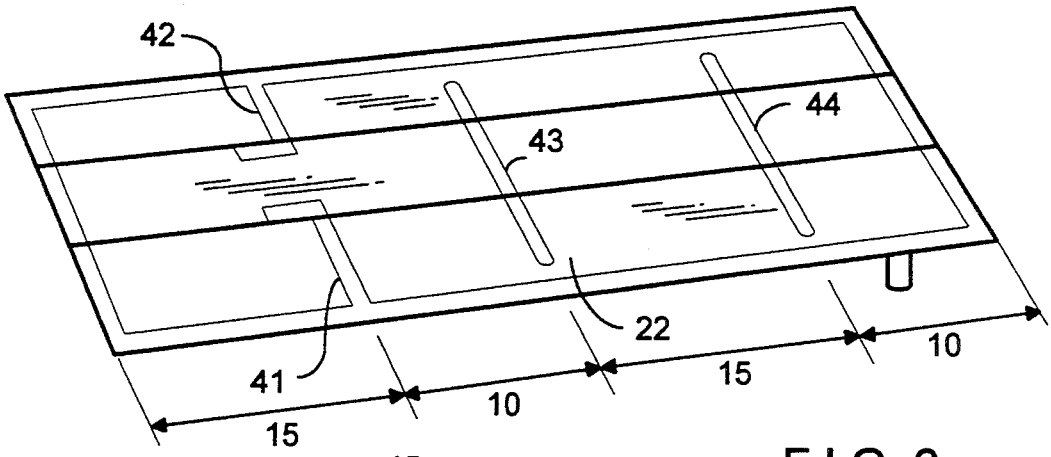
FIG. 6 is a perspective view of another embodiment of the present invention.
Figure 6A:
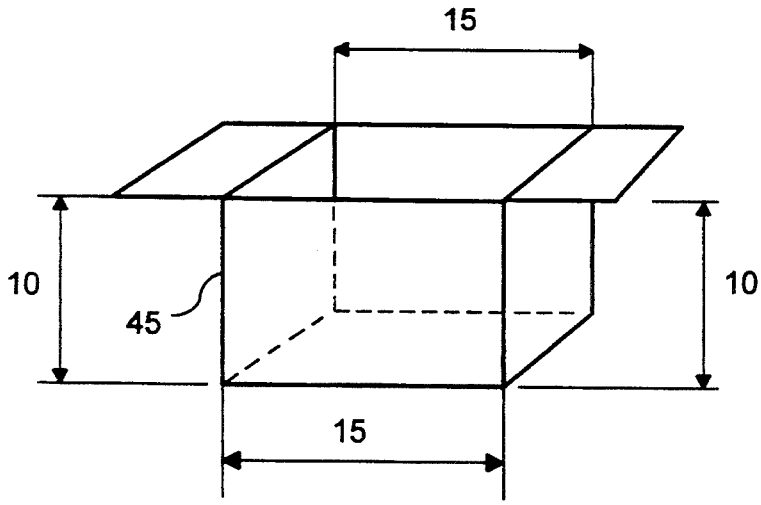
FIG. 6A is a view partially in cross section of a container for the inflatable element of the present invention.

FIG. 6, shows a modification of the single heat-sealed flexible tube having transverse heat seal lines 41, 42, 43 and 44 that form a crease in the bag that registers with the seams and corners of a matching outer container 45, of the type shown, for example, in FIG. 6A.

Figure 7:
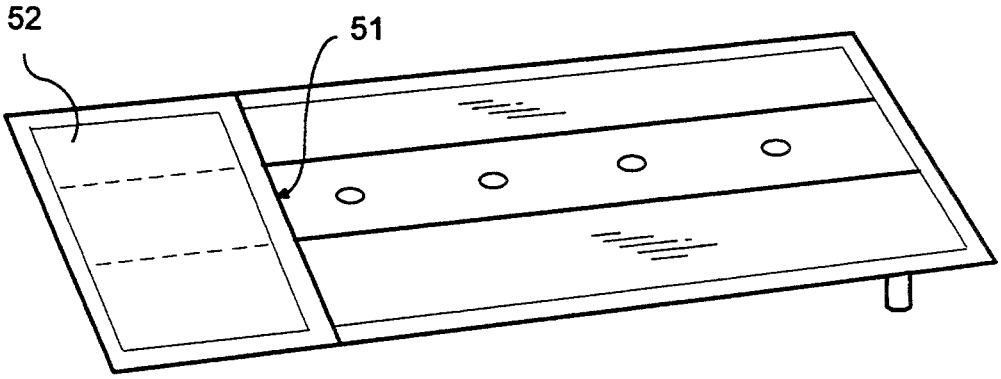
FIG. 7 is a plan view of another embodiment of the present invention.

FIG. 7 shows a modification of the embodiments of FIGS. 4 and 5 in which the inflatable element is provided with an open compartment 51 at one end of the flat, sealed inflatable element. This compartment can be used to hold a product in a fixed location so that the roll-up or fold-up function and subsequent injection of air will not move the packaged product from one end of the bag.

Figure 7A:
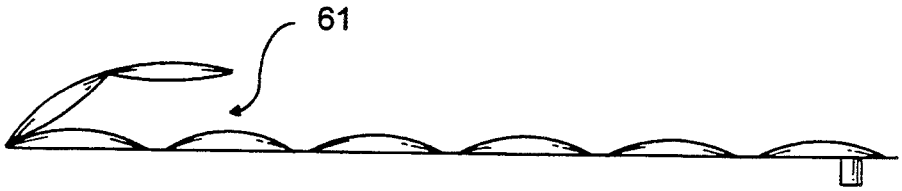
FIG. 7A is a sectional view of the embodiment of FIG. 7 along line 7A—7A of FIG. 7 and looking in the direction of the arrows.

FIG. 7A, is a sectional view of the package depicted in FIG. 7. The long tube is folded and sealed upon itself on the sides only, to form the pouch 51.

Figure 8:
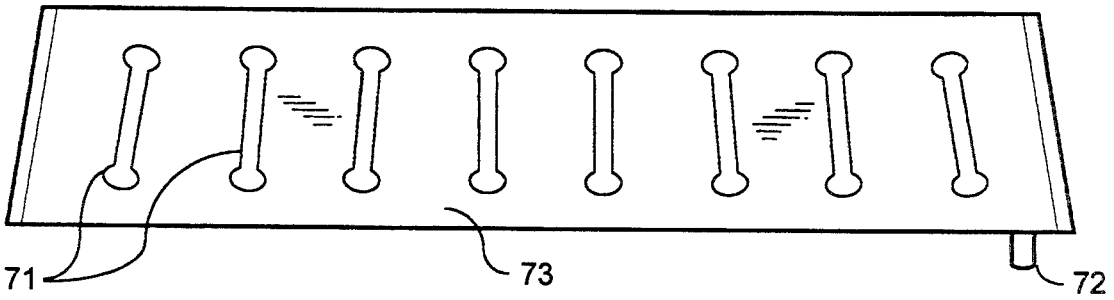
FIG. 8 is a plan view of another embodiment of the present invention.

FIG. 8, shows an embodiment of the invention, wherein transverse heat seals 71 on a two-ply flat pouch provide a "festooning" effect, when inflated. This embodiment is useful for packaging articles such as dinnerware or other fragile products. The vertical rectangle effect will fit into a shipping container to provide multiple inflated compartments, all filled from a single fill port 72. The air flows from compartment to compartment through passageways, e.g. 73, formed by spacing the heat seals apart from connecting edges.

Figure 8A:
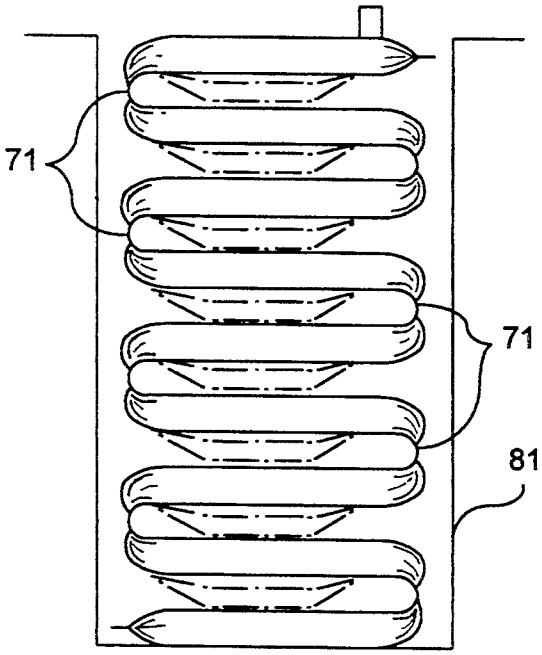
FIG. 8A shows the embodiment of FIG. 8 in use inside a container.

In FIG. 8A, the embodiment of FIG. 8 is shown inserted inside a container 81, such as a wooden shipping crate, a cardboard box (which may be corrugated) or a crate formed of steel or molded plastic.

Figure 8B:
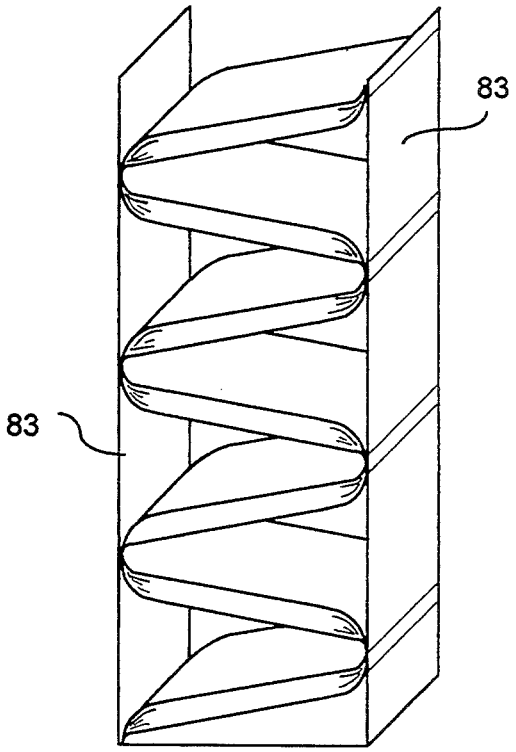
FIG. 8B is another adaptation of the embodiment of FIG. 8.
Figure 8C:
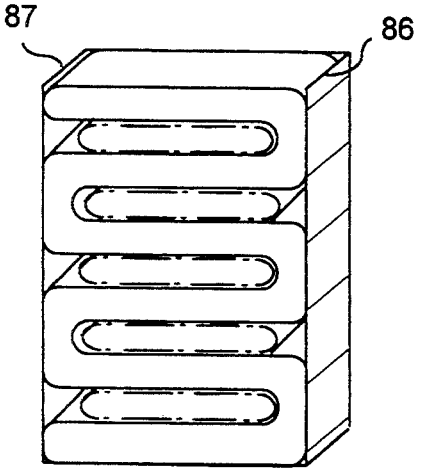
FIG. 8C is another adaptation of the embodiment of FIG. 8.
Figure 8D:
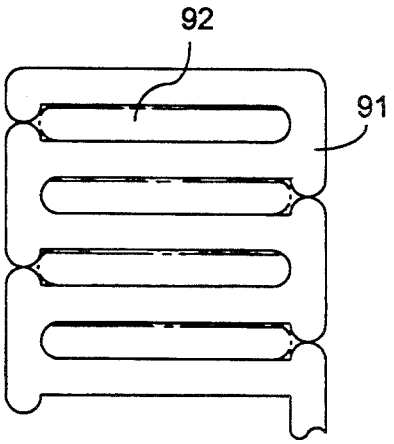
FIG. 8D is a partial view of the package of FIG. 8 shown in an inflated condition.

FIG. 8B, shows another adaptation of the inflatable package embodiment of FIG. 8. In this embodiment, the surrounding or supporting carton or box is provided with a plurality of separate plastic side panels 83 which are heat sealed to the festooned air-packaging system. FIG. 8C is similar to FIG. 8B and shows the package in an inflated condition with plastic supporting side walls 86, 87 that are bonded or spot welded at predetermined points to the plastic material of the inflatable element. FIG. 8D shows a fully inflated package 91 encapsulating a plurality of articles 92 in the folds thereof and snugly fitting within suitable supporting side walls of a container or the like.

In some packaging applications the present invention can serve as the entire shipping container—without using a corrugated carton or other outer container. This is possible for example when the air bag is made of thick thermoplastic films, for example semi-rigid polyvinylchloride sheets having a thickness ranging from 0.020" to 0.060".

In the several embodiments of the present invention, common passageways transmit air injected through one or more molded or plastic film valves 25, 72. These valves are preferably self-closing after injection of air to prevent loss of the pressure required to hold a packaged product in place during shipment. Strategically located heat seals can also serve as "creases" that conform to the inside dimensions of an outer shipping container.

The present invention also provides for environmentally acceptable materials used as the inflatable bag. For example, Polyvinylalcohol (PVA) is a water soluble plastic film that dissolves in less than 24 hours in water (rain). If non-soluble plastics such as polyethylene, polyester, and polyurethane are employed, the invention nevertheless has the advantage that a minimal amount of plastic material is used as dunnage and that when the package is deflated, collapse it into a small, flat pouch and displaces very little area and will over a long period become absorbed by matter and the elements.

It will be understood that other modifications may be made to the structure of the embodiments described hereinabove without departing from the scope of the invention, which is to be measured only by the following claims.

What is claimed is:

1. A packaging system formed of an inflatable device and a matching outer container, the outer container having a plurality of outer panels meeting one another at respective edges, and the inflatable device comprising overlying flexible first and second panels, one of said panels being larger than the other in at least one dimension and having at least one longitudinal fold therein, said panels being sealed together about longitudinal and transverse peripheral edges thereof to define a fillable chamber therebetween, a pocket formed on one exterior surface of one of said panels, and a self-sealable valve accessing said chamber, thereby enabling placement of an article in said pocket, rolling up of said panels around said article, and charging of said chamber with a filler medium;

in which said panels are further sealed together by additional seals at a plurality of locations, at least one of which said locations is coincident with said longitudinal fold, between said longitudinal and transverse peripheral edges and extending in a direction substantially parallel to said transverse peripheral edges to define a plurality of communicating compartments and to define a plurality of fold lines therebetween that are substantially coincident with said additional seals and extend in a direction parallel to said transverse peripheral edges to facilitate folding in a longitudinal direction of said communicating compartments around said article, at least two of said fold lines being spaced apart from each other a distance corresponding to the distance between two edges of the matching outer container.

2. The packaging system of claim 1 in which said flexible panels are made of water soluble plastic film.

3. The packaging system of claim 1 in which said additional seals are formed as a plurality of transverse seams of predetermined length.

* * * * *